US008016407B2

(12) United States Patent
Schierholz et al.

(10) Patent No.: US 8,016,407 B2
(45) Date of Patent: Sep. 13, 2011

(54) PRINTER WITH AN EXPOSURE HEAD

(75) Inventors: Albrecht Schierholz, Schieder-Schwalenberg (DE); Dieter Stellmach, Bad Duerrheim (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 349 days.

(21) Appl. No.: 12/161,670

(22) PCT Filed: Jan. 9, 2007

(86) PCT No.: PCT/EP2007/000113

§ 371 (c)(1),
(2), (4) Date: Jul. 21, 2008

(87) PCT Pub. No.: WO2007/087958

PCT Pub. Date: Aug. 9, 2007

(65) Prior Publication Data

US 2010/0220171 A1 Sep. 2, 2010

(30) Foreign Application Priority Data

Jan. 20, 2006 (DE) ..... 10 2006 003 057

(51) Int. Cl.
*B41J 2/01* (2006.01)

(52) U.S. Cl. ..... 347/102

(58) Field of Classification Search ..... 347/102, 347/225, 226, 231, 238, 108, 155, 156, 165
See application file for complete search history.

(56) References Cited

U.S. PATENT DOCUMENTS

| | | | | |
|---|---|---|---|---|
| 3,831,289 | A | 8/1974 | Knight et al. | |
| 4,434,562 | A * | 3/1984 | Bubley et al. | 34/278 |
| 5,586,013 | A * | 12/1996 | Winston et al. | 362/347 |
| 5,861,633 | A * | 1/1999 | Mandellos | 250/504 R |
| 6,102,547 | A * | 8/2000 | Matsuoto et al. | 362/16 |
| 6,649,921 | B1 | 11/2003 | Cekic et al. | |
| 6,657,722 | B1 * | 12/2003 | Nagayoshi | 356/326 |
| 6,739,716 | B2 * | 5/2004 | Richards | 347/102 |
| 7,073,901 | B2 * | 7/2006 | Mills et al. | 347/102 |
| 7,828,411 | B2 * | 11/2010 | Inoue et al. | 347/34 |
| 2002/0101491 | A1 | 8/2002 | Ervin et al. | |

FOREIGN PATENT DOCUMENTS

| | | |
|---|---|---|
| DE | 7343809 | 3/1975 |
| EP | 0134591 | 3/1985 |
| EP | 1520718 | 4/2005 |
| FR | 2334966 | 7/1977 |
| GB | 2280947 | 2/1995 |
| WO | 9854525 | 12/1998 |

OTHER PUBLICATIONS

International Search Report for International No. PCT/EP2007/000113 mailed on Aug. 14, 2007.

* cited by examiner

*Primary Examiner* — Hai C Pham
(74) *Attorney, Agent, or Firm* — Leydig, Voit & Mayer, Ltd.

(57) ABSTRACT

A printer having an exposure head including an exposure head housing have side walls. The printer also includes a plurality of reflectors disposed in the exposure head housing, the plurality of reflectors including a plurality of elliptical reflectors and a plurality of planar reflectors. A lamp is disposed in the exposure head housing so as to be at least partially surrounded by the plurality of reflectors so that radiation emitted by the lamp during an operation of the printer is directed by the reflectors onto a printed image plane printable with photocurable ink.

18 Claims, 4 Drawing Sheets

PRINTER WITH AN EXPOSURE HEAD

CROSS REFERENCE TO PRIOR APPLICATIONS

This application is a U.S. National Phase application under 35 U.S.C. §371 of International Application No. PCT/EP2007/000113, filed on Jan. 9, 2007 and claims benefit to German Patent Application No. DE 10 2006 003 057.5, filed on Jan. 20, 2006. The International Application was published in German on Aug. 9, 2007 as WO 2007/087958 under PCT Article 21 (2).

FIELD

The present invention relates to a printer, especially to a serial printer, including an exposure head for exposing printed images using photocurable ink.

BACKGROUND

Serial printers or line printers are printers that print one character at a time within a line. They are inexpensive to manufacture, reliable to operate and compact in size, so that they are suitable as tabletop devices.

Printers of this kind are widely employed as type printers, dot-matrix printers or ink-jet printers. When photocurable ink is used in ink-jet printers, then, aside from the printing head, there is a need for an exposure head that runs on a carriage and that, after the printing, exposes the printed image to high-intensity radiation, thus curing it.

For purposes of attaining high radiation intensities, it is a known procedure for sheet-fed offset printing machines to make use of exposure heads with mercury-vapor lamps that reach temperatures of about 900° C. [1652° F.] during operation. Such exposure heads, however, are not suitable for use in tabletop devices because of their large dimensions and the high electric power that has to be installed. The dissipation of the amount of heat generated, which often lies within the kilowatt range, would pose insurmountable difficulties for tabletop devices. In some cases, sheet-fed offset printing machines employ liquid-cooled exposure heads that require cooling aggregates whose dimensions alone already far surpass those of a tabletop device.

The use of exposure heads is also known for large-scale plotters that employ several printing heads on a carriage to simultaneously create several lines of a printed image. These exposure heads are air-cooled and, owing to their large dimensions and their high electric power loss, are not suitable for tabletop devices. Their powerful fans produce noise that far exceeds the permissible noise level in tabletop devices for office applications. This noise reaches the surroundings directly without being muffled since the large-scale plotters are not equipped with a housing. If a housing is installed, the risk exists that the heat energy might accumulate in the housing and cause thermal damage. Moreover, the exposure heads with the reflectors they employ to direct the radiation are not effective to meet the requirements of a serial printer since they make use of elongated, tube-like lamps.

SUMMARY

An aspect of the present invention is to provide a printer that including an exposure head for curing photocurable ink and that lends itself as a tabletop device for office applications.

In an embodiment, the present invention provides a printer having an exposure head including an exposure head housing having side walls. A plurality of reflectors are disposed in the exposure head housing, the plurality of reflectors including a plurality of elliptical reflectors and a plurality of planar reflectors. A lamp is disposed in the exposure head housing so as to be at least partially surrounded by the plurality of reflectors so that radiation emitted by the lamp during operation of the printer is directed by the reflectors onto a printed image plane printable with photocurable ink.

BRIEF DESCRIPTION OF THE DRAWINGS

The present invention is described in greater detail below on the basis of an exemplary embodiment making reference to the drawings.

The following is shown.

DETAILED DESCRIPTION

Figure 1:
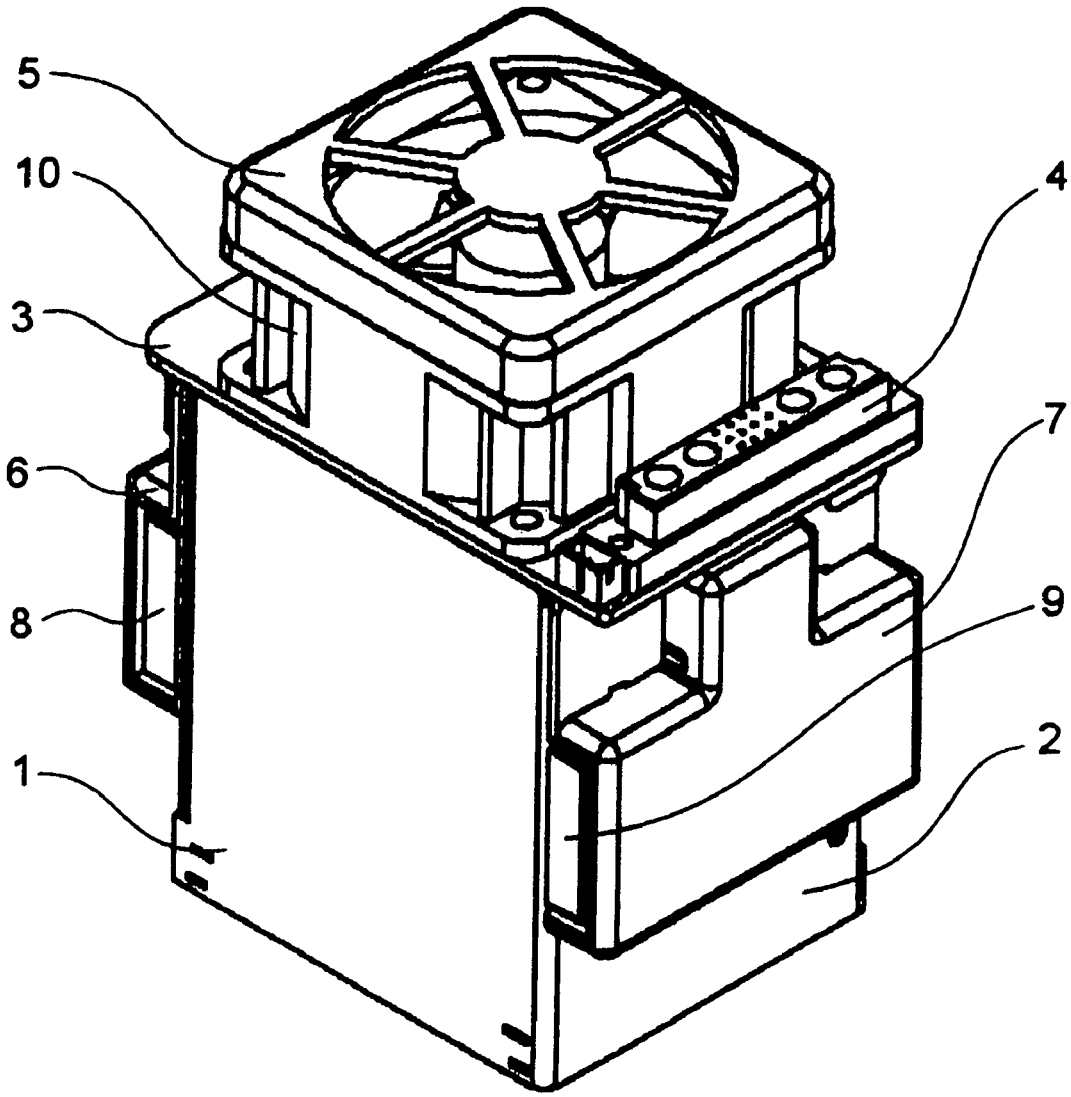
FIG. 1—a perspective view of an embodiment of the exposure head.

The printer according the present invention has an exposure head for exposing printed images, including an exposure head housing in which a lamp is arranged that is at least partially surrounded by reflectors and that, during operation, emits radiation which is directed by the reflectors onto a printed image plane that can be printed with photocurable ink. In order for such printers to be employed as tabletop printers, it is advantageous that the radiation emitted onto the printed image plane by the lamp is of sufficient intensity to cure the ink and that the heat loss from the lamp of the exposure head can be dissipated out of the exposure head and out of the printer, for example, into the surroundings, by a cooler that can be integrated into a tabletop printer.

The combination of the geometrically different reflectors allows a much larger portion of the radiation emitted by the lamp in all directions to be directed onto the printed image plane than is the case with elliptical reflectors only.

This can be done, on the one hand, in that the planar reflectors are arranged on opposite side walls of the housing of the exposure head and are configured as cross reflectors. As a result, especially the edge area of the printed image plane—which is typically exposed to a lower radiation intensity than the center area—may be irradiated with higher intensity.

In this context, the reflection surfaces of the cross reflectors may be slanted with respect to the main beam direction of the lamp in such a manner that the focused beam area at the edge in the direction of the printing line is intensified by the reflected image of the lamp in the focal plane.

In order to further enlarge the edge area of the exposed printed image section, it is advantageously provided that the cross reflectors diverge from each other like a funnel as seen from the lamp in the direction of the printed image plane. The enlargement of the exposed printed image section shortens the exposure time required for curing the ink. An advantage is that the printing speed of the printer can be increased.

For purposes of increasing the radiation intensity, it is likewise possible for the planar reflectors to be arranged on the side of the lamp located opposite from the printed image plane and to be configured as reflector elements.

The radiation emitted by the lamp in the direction opposite from the printed image plane is directed by these reflector elements onto the printed image plane. As a result, not only may the radiation intensity onto the printed image plane be increased but also the heating of the exposure head housing caused by the radiation from the lamp may be reduced.

Another aspect of the present invention is a printer including an exposure head for exposing printed images and an exposure head housing in which a lamp is arranged that is at least partially surrounded by reflectors and that emits radiation during operation that is directed by the reflectors onto a printed image plane that can be printed with photocurable ink.

With this printer, it is provided according to the present invention that a fan unit is connected to the exposure head via at least one air duct, whereby the air duct opens into a cooling-air chamber located between the reflectors and the side walls of the housing of the exposure head.

Owing to this arrangement, the luminous element of the lamp is located in an inner chamber isolated from the reflectors. This may translate into an optimal operating state for the lamp, which has a positive impact on its life service. In addition, intense cooling of the exposure head may be achieved within a minimal space.

According to another embodiment of the present invention, the lamp is affixed in the housing of the exposure head by means of at least one lamp socket, whereby this lamp socket projects into the air duct. An advantage is that the lamp socket is efficiently cooled in the air stream and the dissipation of heat onto the housing of the exposure head is effectively reduced. This air routing is particularly important in order to prevent thermal damage to the housing of the exposure head when mercury-vapor lamps that operate at temperatures of about 900° C. [1652° F.] are employed.

In order to dissipate heated air or the heat loss out of the exposure head, an outgoing air duct is provided that has an inlet opening and an outlet opening and that is connected to the exposure head. In an advantageous manner, it is provided that the inlet opening of the outgoing air duct is arranged between the side walls of the housing of the exposure head and the reflectors. An advantageous refinement of the invention provides that, in the printer housing, an exhaust vent for dissipating heated outgoing air is provided which is preferably arranged so as to correspond to the outlet opening of the air duct of the housing of the exposure head. Consequently, it may be achieved that the heat loss in the housing of the exposure head stemming from the lamp during operation can be transported via a cooling medium such as air, for example, into the surroundings.

According to the perspective view of FIG. 1, the exposure head includes an exposure head housing with angled pieces (1, 2). A board (3) with a connector (4) and a blower (10) configured as a fan unit with a filter (5) is mounted onto the angled pieces (1, 2). Identical outgoing air ducts (6, 7) comprising removable segments (8, 9) are affixed on the sides of both angled pieces (1, 2). By alternately removing the segments (8, 9) in the outgoing air ducts (6, 7), outlet openings are formed through which the outgoing air (44) that was heated up in the exposure head can be systematically vented from one side of the housing of the exposure head.

At least one of these outlet openings is flow-connected to a corresponding exhaust vent provided in the printer housing so that the heated outgoing air can be carried out of the printer and, for example, into the surroundings.

Carriages or rails are installed in the printer housing as guide means for the exposure head and for a printing head with the photocurable ink, so that when the printer is printing, the exposure head and the printing head are controlled by a driver and moved along the carriage or rails so as to traverse between two lateral end positions. In order to achieve good sound insulation by means of the printer housing and to nevertheless allow heated outgoing air to be dissipated, the printer housing only has one exhaust vent. This exhaust vent of the printer housing and the outlet opening of the outgoing air duct (6, 7) are arranged with respect to each other in such a way that the openings are flow-connected in one end position of the exposure head. In this position, the exposure head is briefly stopped during the printing and the heated outgoing air is vented from the printer housing.

Figure 2:
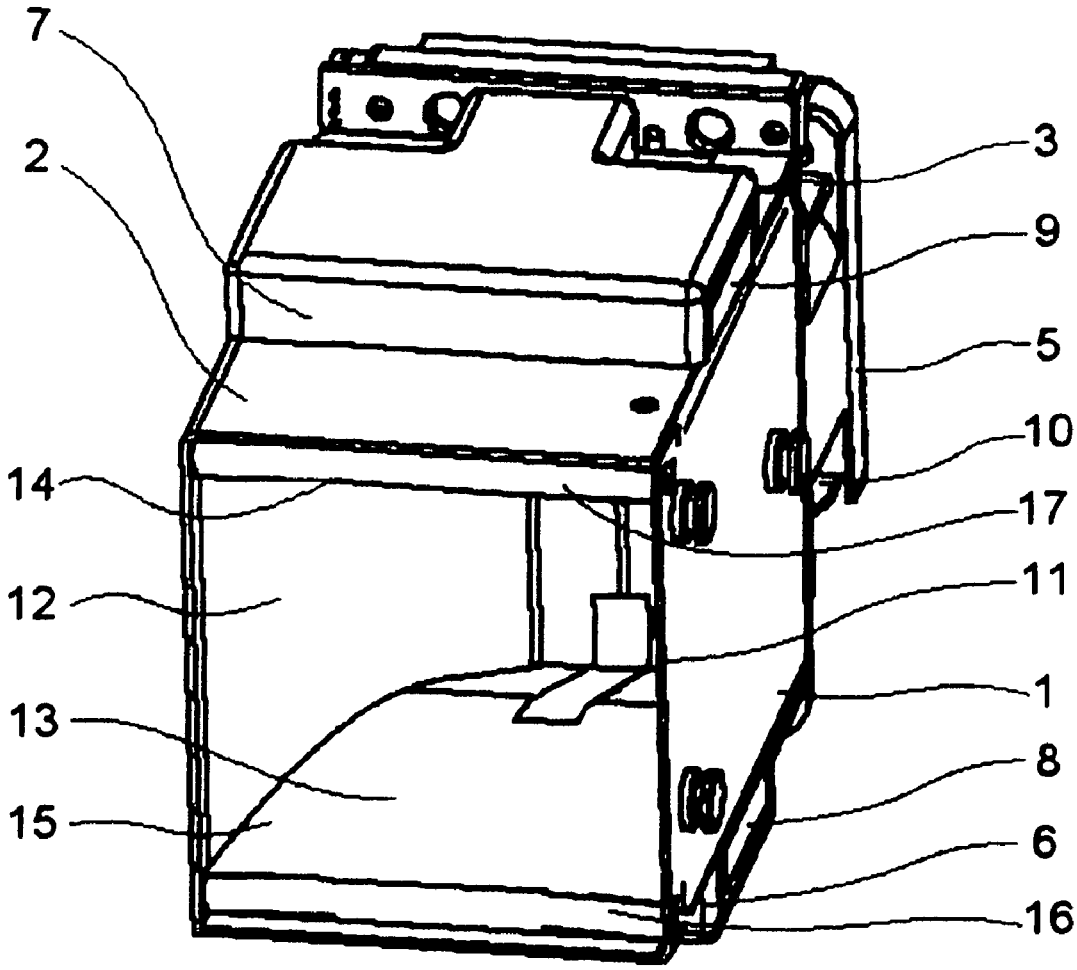
FIG. 2—a perspective view of the light-emitting side of the exposure head.

According to the perspective view of the light-emitting side of the exposure head shown in FIG. 2, the exposure head additionally has elliptical reflectors (11, 12) as well as cross reflectors (13, 14). The light-emitting opening is covered by a glass pane (15) that is secured by the spring elements (16, 17) in the beam shadow. This view does not show a lamp (18) of the exposure head.

Figure 3:
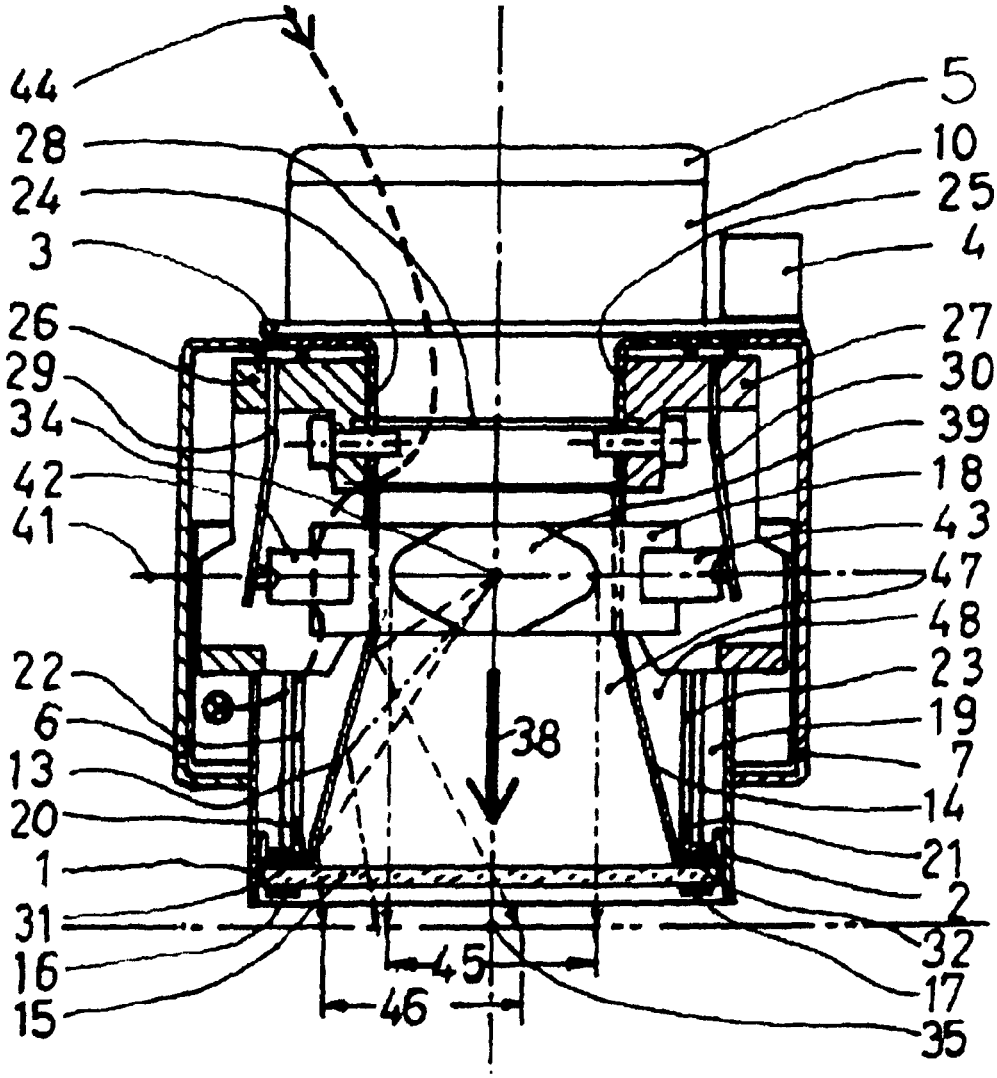
FIG. 3—a cross section through the exposure head, with its beam and cooling-air routing.
Figure 3A:
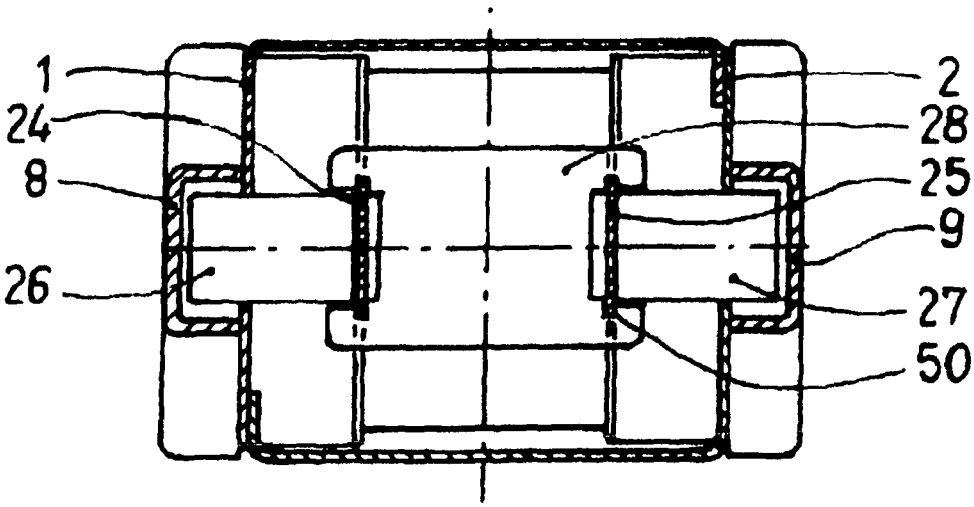
FIG. 3A—a projected cross section of the exposure head of FIG. 3.

According to FIGS. 3 and 3A, the housing of the exposure head is essentially formed by two identical angled pieces (1, 2) that are firmly joined to each other. The inner chamber formed by the angled pieces (1, 2) accommodates two elliptical carriers (20, 21) positioned at a distance (19), each of which has two cutouts (22, 23) that are shaped elliptically. The elliptical reflectors (11, 12) are inserted into these cutouts (22, 23) from the light-emitting side. Since the cutouts (22, 23) are only slightly wider than the thickness of the elliptical reflectors (11, 12), after the assembly, they have a calculated geometrical shape on their reflector surface.

For purposes of attachment and carrying electricity, lamp sockets (26, 27) are installed on both sides on angled inner tabs—bearing the reference numerals 24 and 25—of the angled pieces (1, 2). Above the lamp (18), there is a protective shield (28) that shields the scattered radiation from the lamp (18) towards the top and that additionally stabilizes the two inner tabs (24, 25) of the angled pieces (1, 2) against forces exerted by the socket springs (29, 30).

Above the angled pieces (1, 2), the board (3) with the connector (4) is provided for purposes of supplying the exposure head with electricity, said board (3) being covered by the fan (10) with the upstream air filter (5).

The light-emitting opening of the exposure head is safeguarded against dirt and damage by the glass pane (15). This glass pane (15) is held in place by spring elements (16, 17) that are latched in place in the beam shadow behind an offset (31, 32) formed on the elliptical reflectors (11, 12). This prevents the spring elements from burning out in the direct beam path.

The routing of the cooling air in the exposure head is three-dimensional and is indicated for one side by the broken line (44). The routing of the cooling air on the other side is done in a minor-image manner.

Figure 4:
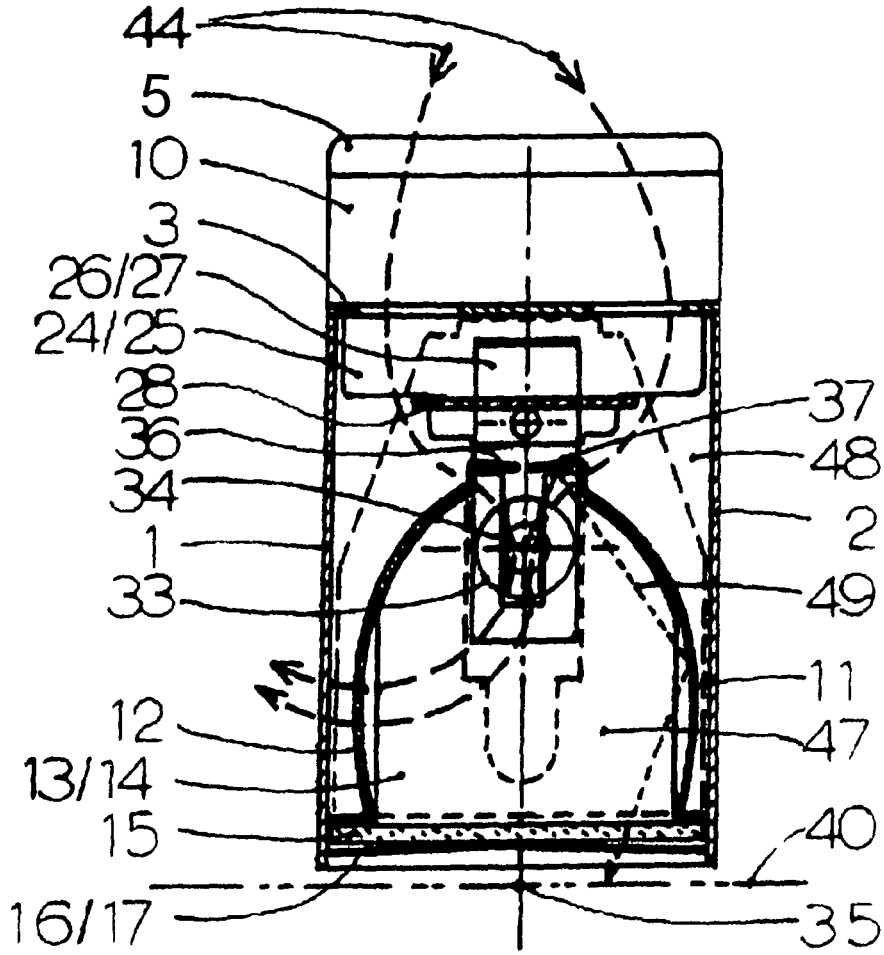
FIG. 4—a cross section through the exposure head, with the cooling-air routing and part of the reflected radiation.
Figure 4A:
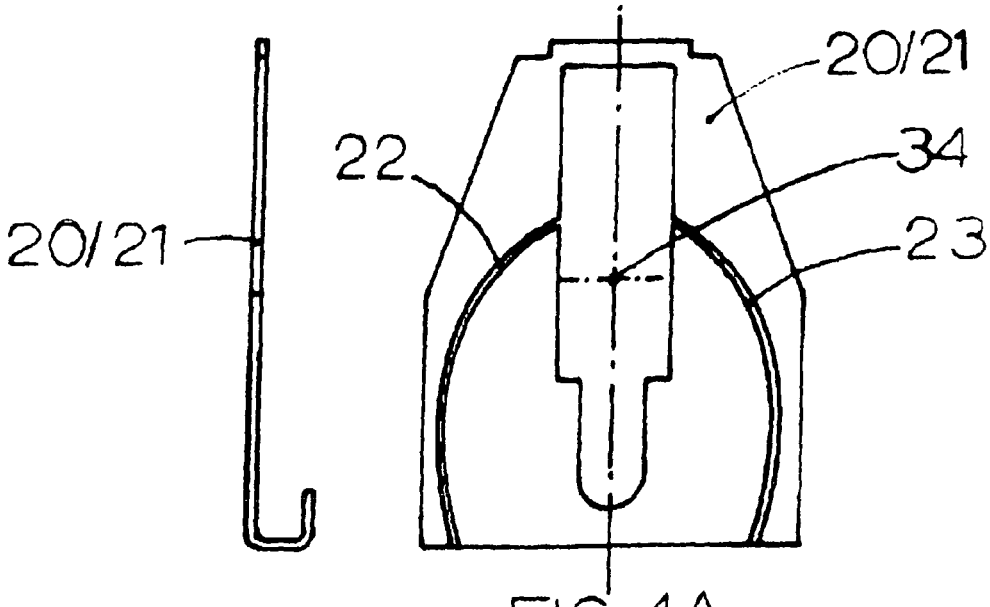
FIG. 4A—the elliptical carrier in two views.

According to FIGS. 4 and 4A, the lamp (18) emits light uniformly from all sides of its cylindrical outer surface. It is arranged in a first focal point (34) of the elliptical reflectors (11, 12). A printed image plane (40) of the printer is located in a second focal point (35).

Above the lamp (18), the cross reflectors (13, 14) have an area (36, 37) configured as reflector elements. This area is slanted relative to the main beam axis (38) in such a manner that the reflected radiation (49) is irradiated largely past the luminous element (39) of the lamp (18) so as not to heat it up unnecessarily and also so as to utilize the reflected radiation (49) for purposes of exposing the printed image plane (40).

The light radiated radially by the luminous element (39) of the lamp (18) is focused by the elliptical reflectors (11, 12) in an area (45) of the printed image plane (40) and consequently intensified multiple times in comparison to direct radiation by the lamp (18).

According to FIG. 3, this area (45) with a higher radiation density and measured in the direction of the longitudinal axis of the lamp (18) is dimensioned only as long as the luminous element (39) of the lamp (18).

In order for the printed image to be cured at the highest possible printing speed, it is advantageous to have the longest possible exposure zone with a corresponding exposure strength in the printed image plane (40) in the direction of printing. In order to achieve this, the cross reflectors (13, 14) are slanted relative to the main beam direction (38) of the lamp (18) to such an extent that the reflected images (46) of the luminous element (39) are imaged by the cross reflectors (13, 14) onto the printed image plane (40) at a high light intensity adjacent to the area (45) generated by the elliptical reflectors (11, 12). This gives rise to a zone (45, 46) having a high radiation density that extends over the entire light-emitting width of the exposure head. In order to accelerate the curing process of the ink after the printing and to prevent the printed image from bleeding, the printed image plane is arranged at a distance of only 1 mm to 2 mm from the exposure head.

The exposure head and the fan unit are connected to each other via an air duct that runs along the broken line designated by the reference numeral 44. The air duct runs past the luminous element (39) of the lamp (18), whereby the lamp socket (26, 27) projects into the air duct. This air duct opens into a cooling-air chamber (48) between the reflectors (11, 12, 13, 14) and the side walls of the housing of the exposure head, as a result of which it is flow-connected via this air duct to the outgoing air duct (7, 8).

LIST OF REFERENCE NUMERALS

1 angled pieces
2 angled pieces
3 board
4 connector
5 filter
6 outgoing air duct
7 outgoing air duct
8 removable segment
9 removable segment
10 fan
11 elliptical reflector
12 elliptical reflector
13 cross reflector
14 cross reflector
15 glass pane
16 leaf spring
17 leaf spring
18 lamp
19 distance
20 elliptical carrier
21 elliptical carrier
22 elliptical cutout
23 elliptical cutout
24 angled inner tab
25 angled inner tab
26 lamp socket
27 lamp socket
28 protective shield
29 spring in the lamp socket
30 spring in the lamp socket
31 offset of the cross reflectors
32 offset of the cross reflectors
34 focal point
35 second focal point
36 reflector element
37 reflector element
38 main beam direction of the lamp
39 luminous element
40 printed image plane
41 lamp axis
42 lamp base
43 lamp base
44 cooling air
45 area of high radiation density
46 reflected image of the luminous element
47 interior of the reflector
48 cooling-air chamber
49 part of the reflected radiation
50 anchor-shaped cutout in the protective shield

The invention claimed is:

1. A printer comprising:

an exposure head disposed in a printer housing and including an exposure head housing having side walls and at least one outgoing air duct configured to dissipate heated air from the exposure head;

at least one guide element disposed in the printer housing and configured to allow traversing movements of the exposure head, wherein an outlet opening of the outgoing air duct is configured to correspond to an exhaust vent of the printer housing when the exposure head is in a predetermined position;

a plurality of reflectors disposed in the exposure head housing, the plurality of reflectors including a plurality of elliptical reflectors and a plurality of planar reflectors; and a lamp disposed in the exposure head housing so as to be at least partially surrounded by the plurality of reflectors so that radiation emitted by the lamp during operation of the printer is directed by the reflectors onto a printed image plane printable with photocurable ink.

2. The printer as recited in claim 1, wherein the printer is a serial printer.

3. The printer as recited in claim 1, wherein the planar reflectors include cross reflectors disposed on opposing side walls of the exposure head housing.

4. The printer as recited in claim 3, wherein the cross reflectors are disposed at a slant towards each other from the lamp in a direction of the printed image plane.

5. The printer as recited in claim 3, wherein the cross reflectors are disposed at a slant away from each other from the lamp in a direction of the printed image plane.

6. The printer as recited in claim 3, wherein the cross reflectors are disposed at a slant toward each other symmetrically with respect to a plane perpendicular to the printed image plane.

7. The printer as recited in claim 1, wherein the planar reflectors include reflector elements disposed on aside of the lamp opposite from the printed image plane.

8. The printer as recited in claim 7, wherein the reflector elements extend in a transverse direction with respect to the lamp.

9. The printer recited in claim 1, wherein the lamp includes a mercury-vapor lamp having a tubular geometry.

10. The printer as recited in claim 1, wherein the planar reflectors are disposed along a slant relative to a transverse direction with respect to the lamp.

11. The printer as recited in claim 10, wherein the, reflector elements extend in a transverse direction with respect to the lamp.

12. The printer as recited in claim 1, wherein the lamp is disposed in a first focal point of the elliptical reflectors.

13. The printer as recited claim 12, wherein the elliptical reflectors, the lamp and the printed image plane are disposed with respect to each other so that a second focal point of the, elliptical reflectors is disposed on the printed image plane.

14. The printer as recited in claim 1, further comprising:

a cooling-air chamber disposed between the reflectors and the side walls; and a fan unit connected to the exposure head via at least one air duct, the at least one air duct opening into the cooling-air chamber.

15. The printer as recited in claim 14, wherein the at least one air duct runs past a luminous element of the lamp.

16. The printer as recited in claim 14, wherein the lamp includes at least one lamp socket configured to attach in the exposure head, wherein the at least one lamp socket projects into the at least one air duct.

17. The printer as recited in claim 14, wherein the at least one air duct includes the at least one outgoing air duct of the exposure head housing having an inlet opening.

18. The printer as recited in claim 17, wherein the inlet opening is disposed between the side walls and the plurality of reflectors.

* * * * *